US012167783B2

(12) United States Patent
Wang

(10) Patent No.: US 12,167,783 B2
(45) Date of Patent: Dec. 17, 2024

(54) ROTARY OPEN-CLOSE TYPE SUN UMBRELLA

(71) Applicant: Linhai Qiuyuan Arts & Crafts Co., Ltd., Zhejiang (CN)

(72) Inventor: Ziguo Wang, Zhejiang (CN)

(73) Assignee: Linhai Qiuyuan Arts & Crafts Co., Ltd.

( * ) Notice: Subject to any disclaimer, the term of this patent is extended or adjusted under 35 U.S.C. 154(b) by 139 days.

(21) Appl. No.: 17/988,413

(22) Filed: Nov. 16, 2022

(65) Prior Publication Data

US 2024/0074554 A1 Mar. 7, 2024

(51) Int. Cl.

| | |
|---|---|
| ***A45B 23/00*** | (2006.01) |
| ***A45B 19/10*** | (2006.01) |
| ***A45B 25/06*** | (2006.01) |
| ***A45B 25/14*** | (2006.01) |
| *A45B 25/18* | (2006.01) |

(52) U.S. Cl.

CPC ..... *A45B 19/10* (2013.01); *A45B 25/06* (2013.01); *A45B 25/14* (2013.01); *A45B 2023/0031* (2013.01); *A45B 2023/005* (2013.01); *A45B 2023/0075* (2013.01); *A45B 2025/186* (2013.01)

(58) Field of Classification Search

CPC ..... A45B 19/10; A45B 25/06; A45B 25/14; A45B 2023/0031; A45B 2023/005; A45B 2023/0075; A45B 2025/186; A45B 25/02; A45B 2023/0012; A45B 2023/0087; A45B 23/00; A45B 2023/0093; A45B 7/005; A45B 2009/005; A45B 2011/005; A45B 2017/005; A45B 2019/004; A45B 2023/0043

USPC ..... 135/20.1, 20.3

See application file for complete search history.

(56) References Cited

U.S. PATENT DOCUMENTS

| | | | | |
|---|---|---|---|---|
| 5,678,585 A * | 10/1997 | May | A45B 25/14 | 135/21 |
| 5,735,302 A * | 4/1998 | Saliva | A45B 25/14 | 135/21 |
| 5,937,882 A * | 8/1999 | Harbaugh | A45B 25/14 | 135/21 |
| 5,947,139 A * | 9/1999 | Lebrecht | E04H 15/003 | 135/132 |
| 6,401,739 B1 * | 6/2002 | Bright | A45B 23/00 | 135/98 |

(Continued)

*Primary Examiner* — Robert Canfield

(74) *Attorney, Agent, or Firm* — Jose Cherson Weissbrot

(57) ABSTRACT

A rotary open-close type sun umbrella includes a standing post, umbrella ribs and umbrella cloths; an unfolding device is arranged at the upper end of the standing post, and the unfolding device is rotatably connected with the standing post; a plurality of umbrella ribs is arranged on the unfolding device, and the umbrella ribs are connected to umbrella cloths; each umbrella cloth is connected with two adjacent umbrella ribs, thus enabling the plurality of umbrella ribs and umbrella cloths to be sequentially connected to form an umbrella surface; the standing post is provided with a driving device, and the driving device is in transmission connection with the unfolding device, thereby allowing the umbrella surface to be unfolded or folded; the rotating arms are rotatably arranged on a mandrel; the mandrel propels one of the rotating arms and the corresponding umbrella rib to rotate.

9 Claims, 7 Drawing Sheets

(56) References Cited

U.S. PATENT DOCUMENTS

| | | | | |
|---|---|---|---|---|
| 7,958,901 | B2 * | 6/2011 | Lai | A45B 23/00 135/20.3 |
| 8,522,804 | B1 * | 9/2013 | Tung | A45B 25/14 135/20.1 |
| 8,763,620 | B1 * | 7/2014 | Tung | A45B 17/00 135/20.1 |
| 10,959,500 | B1 * | 3/2021 | Holbrook | A45B 23/00 |
| 2005/0229959 | A1 * | 10/2005 | Lin | A45B 23/00 135/21 |
| 2006/0107980 | A1 * | 5/2006 | Freestone | A45B 23/00 135/20.1 |
| 2009/0151759 | A1 * | 6/2009 | Glatz | A45B 23/00 135/20.1 |
| 2010/0212705 | A1 * | 8/2010 | Tung | A45B 23/00 135/20.1 |
| 2015/0059815 | A1 * | 3/2015 | Xiong | A45B 23/00 135/20.1 |
| 2015/0068567 | A1 * | 3/2015 | Ma | A45B 23/00 135/20.1 |
| 2015/0366304 | A1 * | 12/2015 | Li | A45B 17/00 135/20.1 |
| 2021/0298435 | A1 * | 9/2021 | Ma | A45B 17/00 |

* cited by examiner

ROTARY OPEN-CLOSE TYPE SUN UMBRELLA

TECHNICAL FIELD

This invention generally relates to the technical field of sun umbrellas, and more particularly, to a rotary open-close type sun umbrella.

BACKGROUND

Sun umbrellas are necessities of people's daily lives and function as a protection against the sun. They are often used in rest areas such as courtyards for providing a comfortable shade. With the improvement of people's living standards, sun umbrellas have become popular and widespread.

Presently, there are various sun umbrellas sold on the market. Conventional sun umbrellas include middle-post umbrellas, hanging umbrellas and bent-arm umbrellas, wherein middle-post umbrellas are merely suitable for being inserted in the middle of a table. When users sit around a table, the umbrella post blocks their sight lines, resulting in poor user experience and narrow application range. Hanging umbrellas and bent-arm umbrellas are suitable for courtyards and public places with suspended ceilings. However, their shortcomings include large space occupation, complex structure, high material cost and high manufacturing cost. Therefore, it is urgent for those skilled in the art to develop a novel sun umbrella.

SUMMARY

The purpose of the present invention is to provide a rotary open-close type sun umbrella having a reasonable structure, capable of providing a one-sided shade, and capable of being flexibly unfolded, folded and conveniently stored.

To achieve the above purpose, the present invention adopts the following technical solution: a rotary open-close type sun umbrella comprises a standing post, umbrella ribs and umbrella cloths; an unfolding device is arranged at the upper end of the standing post, and the unfolding device is rotatably connected with the standing post; a plurality of umbrella ribs are arranged on the unfolding device, and the plurality of umbrella ribs are connected to a plurality of umbrella cloths; each umbrella cloth is connected with two adjacent umbrella ribs, thereby enabling the plurality of umbrella ribs and the plurality of umbrella cloths to be sequentially connected to form an umbrella surface; the standing post is provided with a driving device, and the driving device is in transmission connection with the unfolding device, which allow the umbrella surface to be unfolded or folded.

In another embodiment of the present invention, the upper end of the standing post is provided with a steering mechanism, and the lower end of the unfolding device is connected to the steering mechanism in an interacting mode, thus forming an included angle C between the unfolding device and the standing post. The driving device is connected to the unfolding device through the steering mechanism.

In another embodiment of the present invention, the unfolding device comprises a plurality of rotating arms, the plurality of rotating arms is sequentially arranged on a same center shaft, and an included angle C is formed between the center shaft and the standing post. One end of each umbrella rib is fixedly connected to a corresponding rotating arm. The rotating arm at the lowermost end in the unfolding device is rotatably connected to the steering mechanism, and a limiting structure is arranged between the rotating arm and the steering mechanism. The rotating arm at the uppermost end in the unfolding device is in transmission connection with the steering mechanism, so that the driving device can drive the umbrella surface to unfold or fold through the plurality of rotating arms.

In another embodiment of the present invention, the steering mechanism is provided with a mandrel, and the lower end of the mandrel is rotatably connected to the steering mechanism through a bearing. The mandrel is arranged within the plurality of rotating arms along a central axis in a penetrating manner, and the mandrel is provided with a plurality of shaft sleeves that correspond to the rotating arms in a one-to-one manner. The rotating arm at the uppermost end in the unfolding device is fixedly connected to the mandrel through a shaft sleeve. The shaft sleeves corresponding to the rest of rotating arms are respectively provided with a bearing, and the rest of rotating arms are rotatably connected to the mandrel through shaft sleeves.

In another embodiment of the present invention, the steering mechanism comprises a first bent pipe and a second bent pipe. The lower end of the first bent pipe is fixed to the upper end of the second bent pipe, and an included angle C is formed between the first bent pipe and the second bent pipe. The first bent pipe is provided with a mandrel, the lower end of the mandrel is rotatably arranged in the first bent pipe in a penetrating mode through a bearing, and the upper end of the mandrel is connected to the unfolding device in an interacting mode. A transmission rod is arranged in the standing post, and the lower end of the second bent pipe is fixedly connected with the upper end of the standing post. The upper end of the transmission rod is arranged in the second bent pipe in a penetrating mode, and the transmission rod is respectively connected to the second bent pipe and the standing post through bearings. The upper end of the transmission rod is in transmission connection with the lower end of the mandrel, and the driving device is in transmission connection with the lower end of the transmission rod.

In another embodiment of the present invention, the lower end of the mandrel and the upper end of the transmission rod are engaged by two bevel gears to form a transmission connection.

In another embodiment of the present invention, the lower end of the mandrel and the upper end of the transmission rod form a transmission connection by means of a universal joint.

In another embodiment of the present invention, a limiting device is arranged between the first bent pipe and the rotating arm at the lowermost end in the unfolding device. The limiting structure comprises an extension plate and a stop block. The inner wall of the upper opening of the first bent pipe is provided with a stop block, and the lower opening of the shaft sleeve close to the first bent pipe is provided with an extension plate. The extension plate is arranged in the upper opening of the first bent pipe in a penetrating manner. When the rotating arm on the shaft sleeve rotates around the mandrel, the extension plate and the stop block interact with each other in the circumferential direction of the center shaft.

In another embodiment of the present invention, the driving device comprises a hand rocker and a speed variator. The speed variator is fixedly arranged in the middle of the standing post and is in transmission connection with the lower end of the transmission rod. The hand rocker is arranged on the speed variator.

Compared with the prior art, the present invention has the following advantages: the present invention has a reasonable structure; the unfolding device is propelled by a hand rocker; the rotating arms are rotatably arranged on a mandrel; the mandrel propels one of the rotating arms and the corresponding umbrella rib to rotate; the plurality of umbrella ribs are connected through umbrella cloths such that an umbrella surface is formed after the umbrella cloths are unfolded sequentially; an included angle C is formed between the unfolding device and the standing post; when folded, the rotating arms are attached to the standing post, thereby reducing the space occupation while achieving a flexible use.

Figure 1:
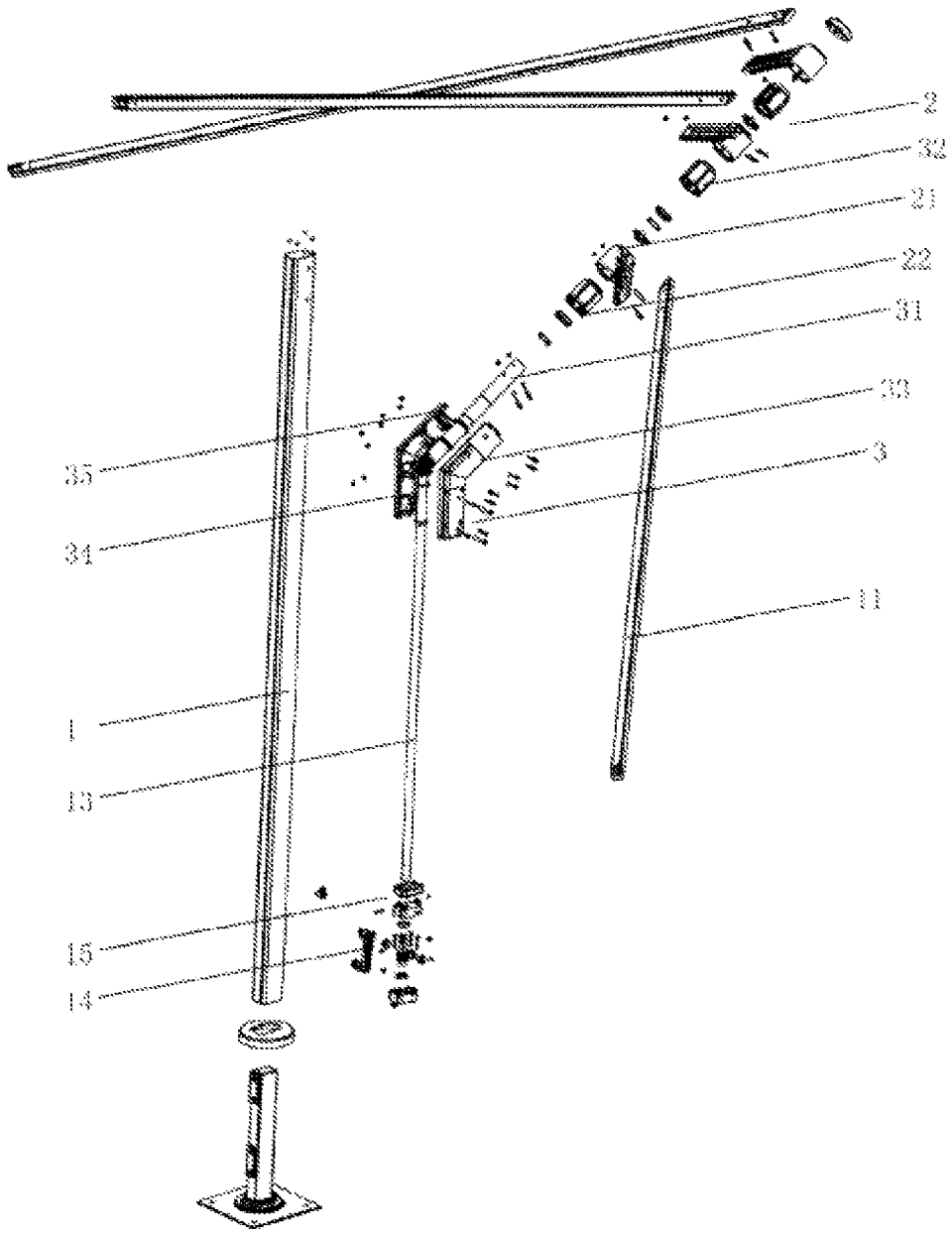
FIG. 1 is a conceptual diagram illustrating an explosive view of the main body without umbrella cloths of the present invention.
Figure 2:
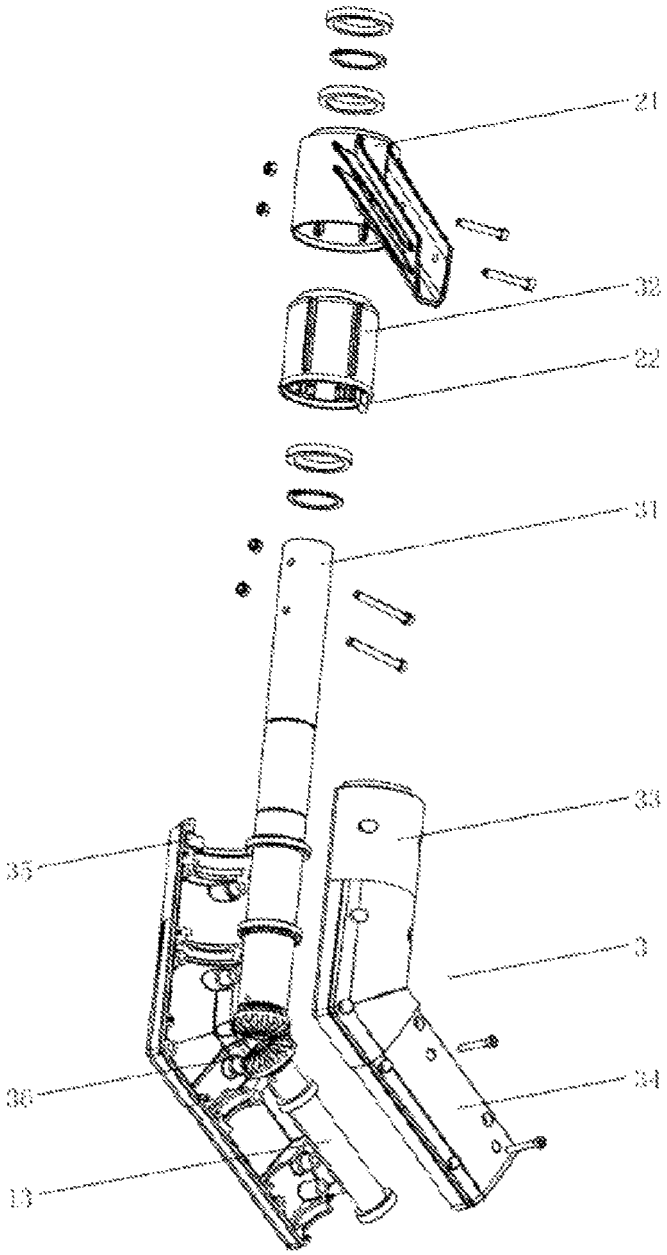
FIG. 2 is conceptual diagram illustrating an explosive view of the steering mechanism in embodiment 1 of the present invention.
Figure 3:
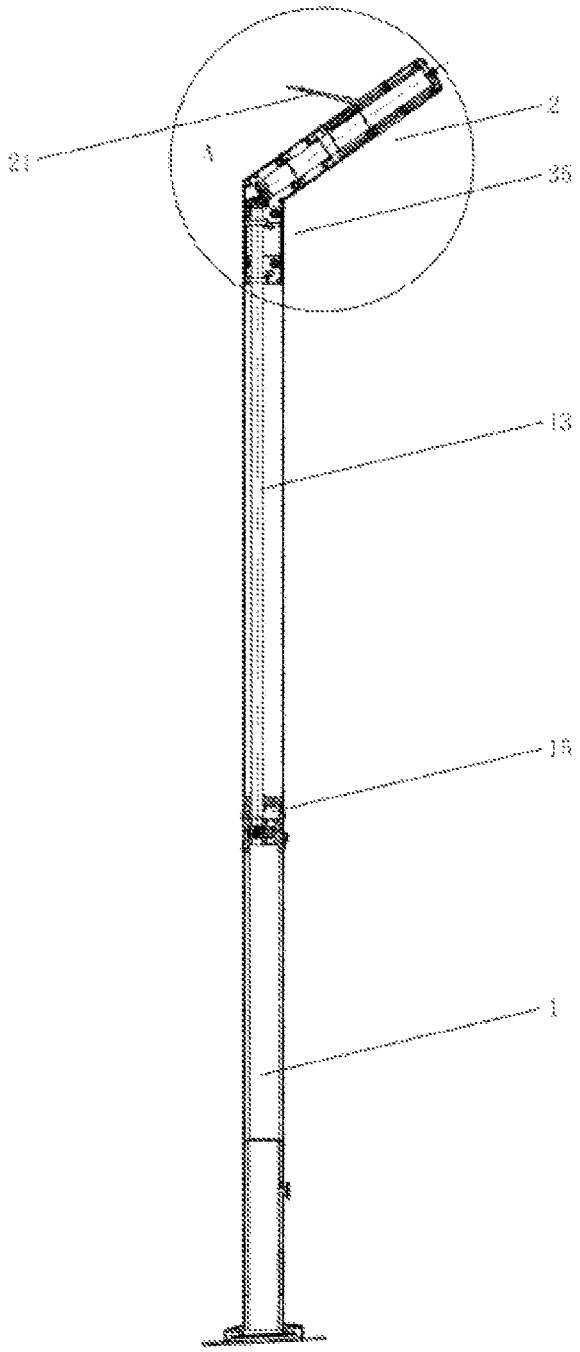
FIG. 3 is a conceptual diagram illustrating a sectional view of the present invention.
Figure 4:
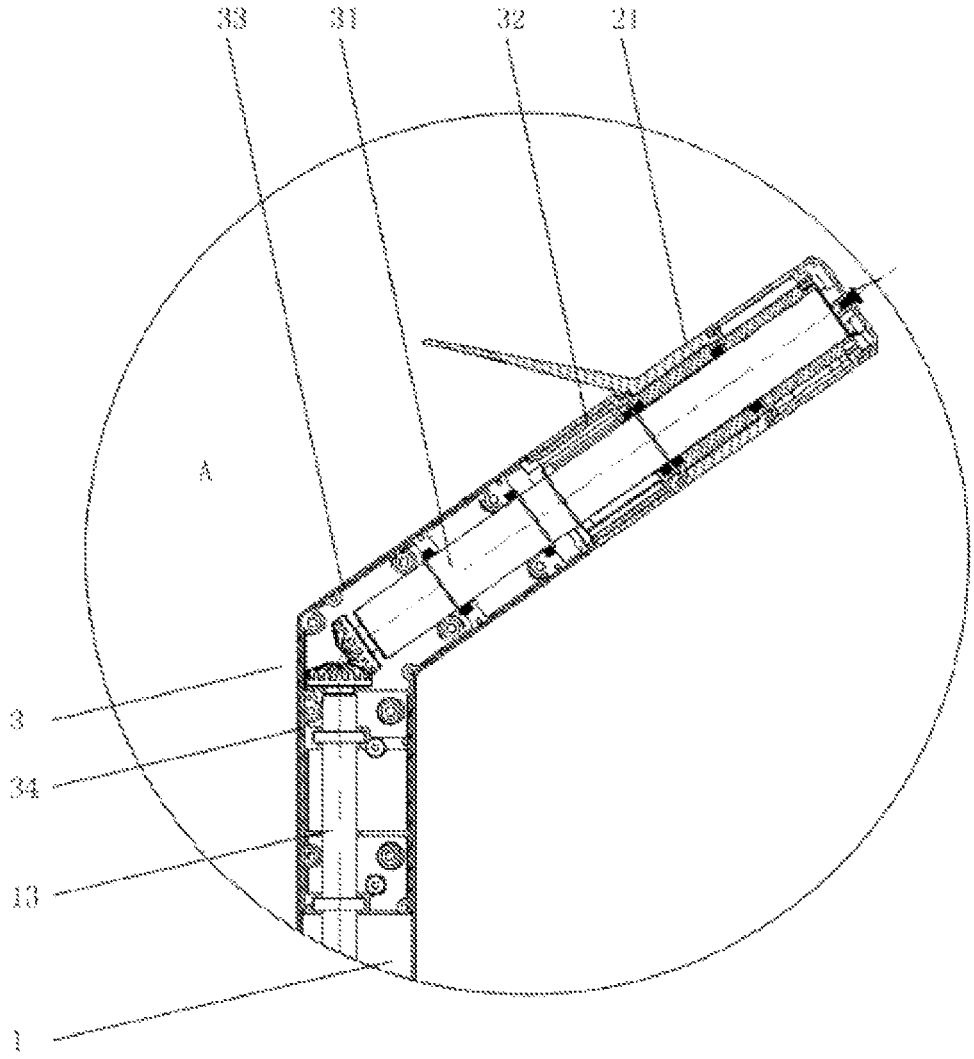
FIG. 4 is a conceptual diagram illustrating an enlarged structure of portion A in FIG. 3.
Figure 5:
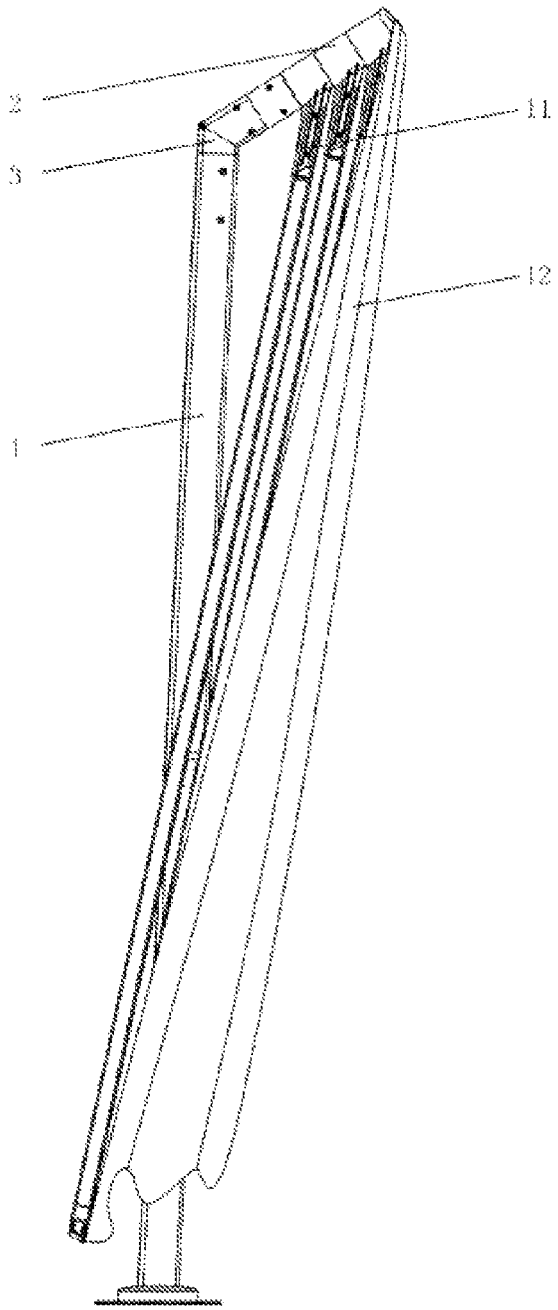
FIG. 5 is a conceptual diagram illustrating an overall structure of the present invention in a folded state.
Figure 6:
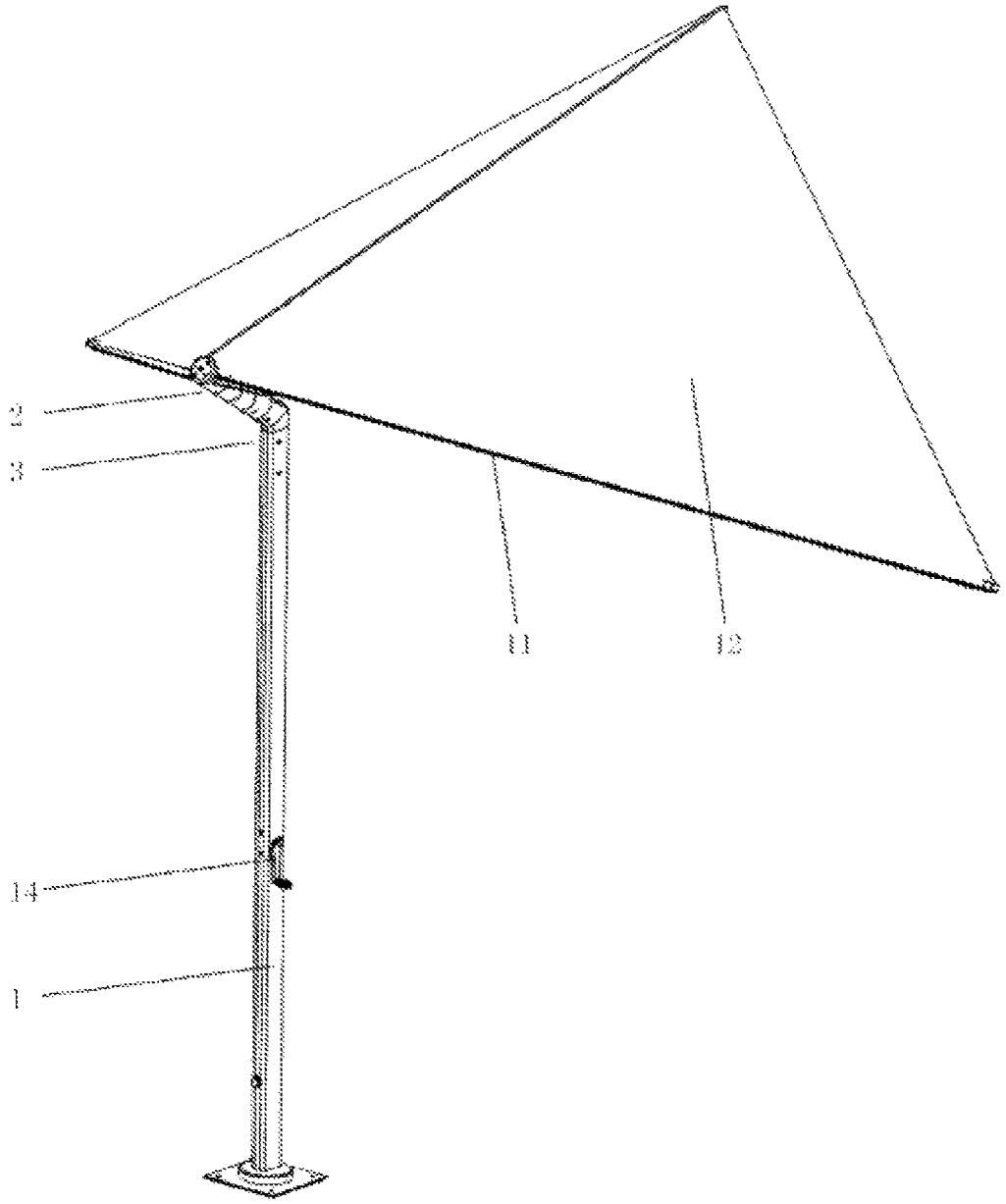
FIG. 6 is a conceptual diagram illustrating an overall structure of the present invention in an unfolded state.

In Figures: 1—Standing Post, 2—Unfolding Device, 3—Steering Mechanism, 11—Umbrella Rib, 12—Umbrella Cloth, 13—Transmission Rod, 14—Hand Rocker, 15—Speed Variator, 21—Rotating Arm, 22—Extension Plate, 31—Mandrel, 32—Shaft Sleeve, 33—The First Bent Pipe, 34—The Second Bent Pipe, 35—Stop Block, 36—Bevel Gear, 37—Universal Joint.

DETAILED DESCRIPTION

Drawings and detailed embodiments are combined hereinafter to elaborate the technical solution of the present invention.

Embodiment 1

As shown in FIGS. 1-6, the rotary open-close type sun umbrella of the present invention comprises a standing post 1, umbrella ribs 11 and umbrella cloths 12. An unfolding device 2 is arranged at the upper end of the standing post 1, and the unfolding device 2 is rotatably connected with the standing post 1. A plurality of umbrella ribs 11 are arranged on the unfolding device 2, and the plurality of umbrella ribs 11 are connected to a plurality of umbrella cloths 12. Each umbrella cloth 12 is connected with two adjacent umbrella ribs 11. Thus, the plurality of umbrella ribs 11 and the plurality of umbrella cloths 12 are sequentially connected to form an umbrella surface. The standing post 1 is provided with a driving device, and the driving device is in transmission connection with the unfolding device 2, thereby allowing the umbrella surface to be unfolded or folded. The umbrella cloths 12 are connected with the umbrella ribs 11 to form an umbrella surface, and one end of each umbrella rib 11 is connected with the unfolding device 2. In this way, when the umbrella surface is unfolded by using the unfolding device 2, and when the unfolding angle or rotating angle of the unfolding device 2 is less than 360 degrees, the umbrella surface forms a non-full-circle structure. Alternatively, when the unfolding angle or rotating angle of the unfolding device 2 is 360 degrees, the umbrella surface form a full-circle structure around the standing post 1. Preferably, in this embodiment, the unfolding angle of the unfolding device 2 is near 180 degrees. The umbrella ribs 11 and umbrella cloths 12 form a semi-circular umbrella surface when being driven by the unfolding device 2. Through adopting the present invention, the technical problem that the standing post needs to be arranged at the center of the table top is solved. The lower end of the standing post 1 is provided with a fixing structure, such as a bottom foot or a bottom plate, which enables the standing post 1, the unfolding device 2, the umbrella ribs 11 and the umbrella surface to be stably arranged on the ground, thereby stably providing a shade for the user.

The upper end of the standing post 1 is provided with a steering mechanism 3, and the lower end of the unfolding device 2 is connected to the steering mechanism 3 in an interacting mode, thereby forming an included angle C between the unfolding device 2 and the standing post 1. The driving device is connected to the unfolding device 2 through the steering mechanism 3. The steering mechanism 3 allows the unfolding device 2 to be obliquely arranged at the upper end of the standing post 1. The included angle C formed between the unfolding device 2 and the standing post 1 enables the plurality of umbrella ribs 11 arranged around the unfolding device 2 to droop in a folded state. Moreover, the umbrella ribs 11 may be approximately parallel to the standing post 1, so that the space occupation of the sun umbrella is significantly reduced during storage and transportation. Definitely, the included angle C ranges from 45 to 75 degrees, and an included angle is formed between each umbrella rib 11 and the rotating shaft of the unfolding device 2. Thus, when being folded, the umbrella ribs 11 are in a drooping state.

The unfolding device 2 comprises a plurality of rotating arms 21, the plurality of rotating arms 21 are sequentially arranged on a same center shaft, and an included angle C is formed between the center shaft and the standing post 1. One end of each umbrella rib 11 is fixedly connected to a corresponding rotating arm 21. The rotating arm 21 at the lowermost end in the unfolding device 2 is rotatably connected to the steering mechanism 3, and a limiting structure is arranged between the rotating arm 21 and the steering mechanism 3. The rotating arm 21 at the uppermost end in the unfolding device 2 is in transmission connection with the steering mechanism 3, so that the driving device can drive the umbrella surface to unfold or fold through the plurality of rotating arms 21. The rotating arm 21 may rotate around the central axis of the unfolding device 2, and the rotating arm 21 at the uppermost end in the unfolding device 2 is driven by the steering mechanism 3. The umbrella rib 11 connected to the rotating arm 21 at the uppermost end in the unfolding device 2 rotates around the center shaft and sequentially drives other umbrella ribs 11 and rotating arms 21 through the umbrella cloth 12. Thus, the plurality of umbrella ribs 11 and the umbrella cloths 12 are sequentially unfolded to form an umbrella surface. After the umbrella surface is formed, the rotating arm 21 at the lowermost end in the unfolding device 2 and the steering mechanism 3 are connected through a limiting structure, thereby preventing the rotating arm 21 from rotating. Preferably, the plurality of rotating arms 21 of the unfolding device 2 are sequentially linked through the umbrella cloths 12. Contrarily, when the rotating arm 21 at the uppermost end rotates reversely, other rotating arms 21 may also be driven such that the plurality of umbrella ribs 11 render a drooping state.

The steering mechanism 3 is provided with a mandrel 31, and the lower end of the mandrel 31 is rotatably connected to the steering mechanism 3 through a bearing. The mandrel 31 is arranged within the plurality of rotating arms 21 along a central axis in a penetrating manner, and the mandrel 31 is provided with a plurality of shaft sleeves 32 that correspond to the rotating arms 21 in a one-to-one manner. The rotating arm 21 at the uppermost end in the unfolding device 2 is fixedly connected to the mandrel 31 through a shaft sleeve 32. The shaft sleeves 32 corresponding to the rest of rotating arms 21 are respectively provided with a bearing, and the rest of rotating arms 21 are rotatably connected to the mandrel 31 through shaft sleeves 32. The shaft sleeves 32 are arranged on the mandrel 31 through bearings, and the shaft sleeves 32 are connected to the rotating arms 21 in an interacting mode. Thus, the shaft sleeves are axially limited, and the plurality of rotating arms 21 are enabled to rotate relatively around the center shaft. Further, the rotating arm 21 at the uppermost end in the unfolding device 2 is fixedly connected to the mandrel 31 through a shaft sleeve 32. When the driving device propels the mandrel 31 to rotate through the steering mechanism 3, the mandrel 31 propels the rotating arm 21 at the uppermost end to rotate. In this way, the plurality of rotating arms 21, umbrella ribs 11 and umbrella cloths 12 are sequentially unfolded to form an umbrella surface.

The steering mechanism 3 comprises a first bent pipe 33 and a second bent pipe 34. The lower end of the first bent pipe 33 is fixed to the upper end of the second bent pipe 34, and an included angle C is formed between the first bent pipe 33 and the second bent pipe 34. The first bent pipe 33 is provided with a mandrel 31, the lower end of the mandrel 31 is rotatably arranged in the first bent pipe 33 in a penetrating mode through a bearing, and the upper end of the mandrel 31 is connected to the unfolding device 2 in an interacting mode. A transmission rod 13 is arranged in the standing post 1, and the lower end of the second bent pipe 34 is fixedly connected with the upper end of the standing post 1. The upper end of the transmission rod 13 is arranged in the second bent pipe 34 in a penetrating mode, and the transmission rod 13 is respectively connected to the second bent pipe 34 and the standing post 1 through bearings. The upper end of the transmission rod 13 is in transmission connection with the lower end of the mandrel 31, and the driving device is in transmission connection with the lower end of the transmission rod 13. Because an included angle C is formed between the unfolding device 2 and the standing post 1, the driving device needs the steering mechanism to realize a transmission connection. The first bent pipe 33 and the second bent pipe 34 are respectively connected to the unfolding device 2 and the standing post 1. The first bent pipe 33 is rotatably connected to the unfolding device 2 through the mandrel 31, and the mandrel 31 is fixedly connected to the uppermost end of the rotating arm 21 to achieve a rigid transmission. To prevent the plurality of rotating arms 21 from being separated from the upper end of the mandrel 31, the upper end of the mandrel 31 is provided with a cover plate for fixing the unfolding device 2.

The lower end of the mandrel 31 and the upper end of the transmission rod 13 are engaged by two bevel gears 36 to form a transmission connection. The steering mechanism 3 is used for forming an included angle C between the unfolding device 2 and the standing post 1. An included angle C is also formed between the mandrel 31 and the transmission rod 13, and the mandrel 31 is rotatably arranged in the first bent pipe 33 through a bearing. The transmission rod 13 is rotatably arranged in the standing post 1 through a bearing. The transmission rod 13 and the mandrel 31 are engaged by means of the two bevel gears 36, thereby achieving the power transmission between the transmission rod 13 and the mandrel 31. In this way, the driving device propels the unfolding device 2 to unfold or fold the umbrella surface.

A limiting device is arranged between the first bent pipe 33 and the rotating arm 21 at the lowermost end in the unfolding device 2. The limiting structure comprises an extension plate 22 and a stop block 35. The inner wall of the upper opening of the first bent pipe 33 is provided with a stop block 35, and the lower opening of the shaft sleeve 32 close to the first bent pipe 33 is provided with an extension plate 22. The extension plate 22 is arranged in the upper opening of the first bent pipe 33 in a penetrating manner. When the rotating arm 21 on the shaft sleeve 32 rotates around the mandrel 31, the extension plate 22 and the stop block 35 interact with each other in the circumferential direction of the center shaft. The limiting device is used for limiting the moving angle of the rotating arm 21 at the lowermost end on the mandrel 31. When the rotating angle of the rotating arm 21 at the uppermost end exceeds 180 degrees, the umbrella cloth 12 on this rotating arm 21 is completely unfolded, and other umbrella ribs 11 and umbrella cloths 12 are also propelled to be unfolded to form an umbrella surface. At this point, the extension plate 22 abuts against the stop block 35 to prevent the rotating arm 21 at the lowermost end from rotating continuously, thereby enabling the unfolding device 2 to respectively unfold the plurality of umbrella ribs 11 and umbrella cloths. Thus, a stable sun umbrella surface is formed on the standing post 1.

The driving device comprises a hand rocker 14 and a speed variator 15. The speed variator 15 is fixedly arranged in the middle of the standing post 1 and is in transmission connection with the lower end of the transmission rod 13. The hand rocker 14 is arranged on the speed variator 15. Preferably, in the present invention, a hand rocker 14 and a speed variator 15 are adopted to propel the transmission rod 13 and the unfolding device 2. Definitely, the driving device may also adopt an electric mode, namely, a motor being arranged on the transmission device 15 for serving as a power source. Correspondingly, the limiting device is provided with a movement control sensor, and the motor is turned off when the umbrella surface is fully unfolded.

Embodiment 2

Figure 7:
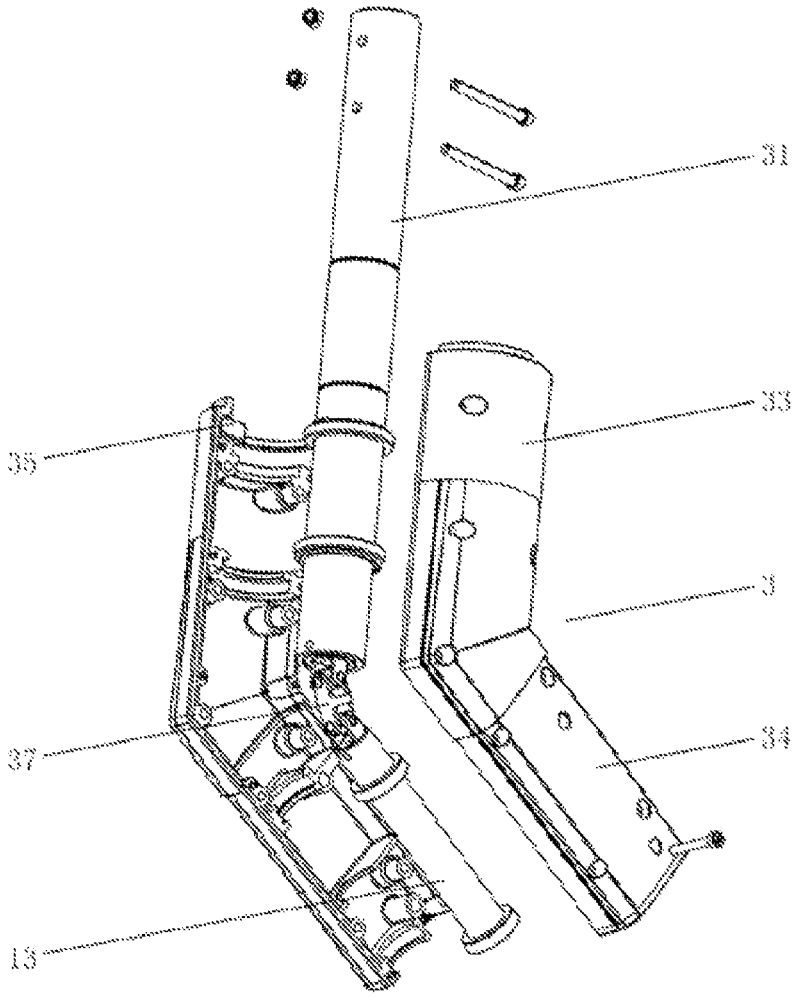
FIG. 7 is conceptual diagram illustrating an explosive view of the steering mechanism in embodiment 2 of the present invention.

As shown in FIG. 7, the difference between embodiment 7 and embodiment 1 is that a transmission connection is formed between the lower end of the mandrel 31 and the upper end of the transmission rod 13 by means of a universal joint 37. The steering mechanism 3 is used for forming an included angle C between the unfolding device 2 and the standing post 1. Similarly, an included angle C is also formed between the mandrel 31 and the transmission rod 13. The mandrel 31 is rotatably arranged in the first bent pipe 33 through a bearing, and the transmission rod 13 is rotatably arranged in the standing post 1 through a bearing. The mandrel 31 and the transmission rod 13 are connected through the universal joint 37 such that power transmission is realized between the transmission rod 13 and the mandrel 31. In this way, the driving device is capable of propelling the unfolding device 2 to unfold or fold the umbrella surface.

The above are merely preferred embodiments of the present invention. Therefore, equivalent changes or modifications made according to the structures, features and principles described in the specification of the present invention shall fall into the scope defined by the claims of the present invention.

What is claimed is:

1. A rotary sun umbrella, comprising:

a standing post (1), a plurality of umbrella ribs (11), and umbrella cloths (12), wherein an unfolding device (2) is arranged at an upper end of the standing post (1), and wherein the unfolding device (2) is rotatably connected with the standing post (1), wherein the plurality of umbrella ribs (11) are arranged on the unfolding device (2), and wherein the plurality of umbrella ribs (11) are connected to a plurality of umbrella cloths (12), wherein each umbrella cloth (12) is connected with two adjacent umbrella ribs (11), thereby enabling the plurality of umbrella ribs (11) and the plurality of umbrella cloths (12) to be sequentially connected to form an umbrella surface, wherein the standing post (1) is provided with a driving device, and wherein the driving device is in transmission connection with the unfolding device (2), which allow the umbrella surface to be unfolded or folded.

2. The rotary sun umbrella of claim 1, wherein the upper end of the standing post (1) is provided with a steering mechanism (3), and wherein a lower end of the unfolding device (2) is connected to the steering mechanism (3) in an interacting mode, thus forming an included angle C between the unfolding device (2) and the standing post (1), wherein the driving device is connected to the unfolding device (2) through the steering mechanism (3).

3. The rotary umbrella of claim 2, wherein the unfolding device (2) further comprising a plurality of rotating arms (21), wherein the plurality of rotating arms (21) are sequentially arranged on a same center shaft, and wherein the included angle C is formed between the center shaft and the standing post (1), wherein one end of each umbrella rib (11) is fixedly connected to a corresponding rotating arm (21), wherein the rotating arm (21) at a lowermost end in the unfolding device (2) is rotatably connected to the steering mechanism (3), and wherein a limiting structure is arranged between the rotating arm (21) and the steering mechanism (3), wherein the rotating arm (21) at an uppermost end in the unfolding device (2) is in transmission connection with the steering mechanism (3), so that the driving device is capable of driving the umbrella surface to unfold or fold through the plurality of rotating arms (21).

4. The rotary sun umbrella of claim 3, wherein the steering mechanism (3) is provided with a mandrel (31), and the lower end of the mandrel (31) is rotatably connected to the steering mechanism (3) through a bearing, wherein the mandrel (31) is arranged within the plurality of rotating arms (21) along a central axis in a penetrating manner, and wherein the mandrel (31) is provided with a plurality of shaft sleeves (32) that correspond to the rotating arms (21), wherein each shaft sleeve corresponds to a rotating arm, wherein the rotating arm (21) at the uppermost end in the unfolding device (2) is fixedly connected to the mandrel (31) through a shaft sleeve (32), wherein the shaft sleeves (32) corresponding to the rest of rotating arms (21) are respectively provided with a bearing, and wherein the rest of rotating arms (21) are rotatably connected to the mandrel (31) through shaft sleeves (32).

5. The rotary sun umbrella of claim 4, wherein the steering mechanism (3) further comprising a first bent pipe (33) and a second bent pipe (34), wherein a lower end of the first bent pipe (33) is fixed to an upper end of the second bent pipe (34), and wherein an included angle C is formed between the first bent pipe (33) and the second bent pipe (34), wherein the first bent pipe (33) is provided with a mandrel (31), the lower end of the mandrel (31) is rotatably arranged in the first bent pipe (33) in a penetrating mode through a bearing, and wherein an upper end of the mandrel (31) is connected to the unfolding device (2) in an interacting mode, wherein a transmission rod (13) is arranged in the standing post (1), and wherein the lower end of the second bent pipe (34) is fixedly connected with the upper end of the standing post (1), wherein the upper end of the transmission rod (13) is arranged in the second bent pipe (34) in a penetrating mode, and wherein the transmission rod (13) is respectively connected to the second bent pipe (34) and the standing post (1) through bearings, wherein the upper end of the transmission rod (13) is in transmission connection with the lower end of the mandrel (31), and wherein the driving device is in transmission connection with the lower end of the transmission rod (13).

6. The rotary sun umbrella of claim 5, wherein the lower end of the mandrel (31) and the upper end of the transmission rod (13) are engaged by two bevel gears (36) to form a transmission connection.

7. The rotary sun umbrella of claim 5, wherein the lower end of the mandrel (31) and the upper end of the transmission rod (13) form a transmission connection by means of a universal joint.

8. The rotary sun umbrella of claim 5, wherein a limiting device is arranged between the first bent pipe (33) and the rotating arm (21) at a lowermost end in the unfolding device (2), wherein the limiting structure further comprising an extension plate (22) and a stop block (35), wherein an inner wall of an upper opening of the first bent pipe (33) is provided with a stop block (35), and wherein a lower opening of the shaft sleeve (32) close to the first bent pipe (33) is provided with an extension plate (22), wherein the extension plate (22) is arranged in an upper opening of the first bent pipe (33) in a penetrating manner, wherein when the rotating arm (21) on the shaft sleeve (32) rotates around the mandrel (31), the extension plate (22) and the stop block (35) interact with each other in circumferential direction of the center shaft.

9. The rotary sun umbrella of claim 5, wherein the driving device further comprising a hand rocker (14) and a speed variator (15), wherein the speed variator (15) is fixedly arranged in the middle of the standing post (1) and is in transmission connection with a lower end of the transmission rod (13), wherein the hand rocker (14) is arranged on the speed variator.

* * * * *